US009455497B2

(12) United States Patent
Wu

(10) Patent No.: US 9,455,497 B2
(45) Date of Patent: Sep. 27, 2016

(54) MULTI-BAND ANTENNA

(71) Applicant: Jing Wu, Shenzhen (CN)

(72) Inventor: Jing Wu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 83 days.

(21) Appl. No.: 14/597,362

(22) Filed: Jan. 15, 2015

(65) Prior Publication Data

US 2016/0134018 A1 May 12, 2016

(30) Foreign Application Priority Data

Nov. 10, 2014 (CN) ..... 2014 2 0668356 U

(51) Int. Cl.

| | |
|---|---|
| ***H01Q 1/38*** | (2006.01) |
| ***H01Q 5/385*** | (2015.01) |
| ***H01Q 19/00*** | (2006.01) |
| ***H01Q 5/392*** | (2015.01) |

(52) U.S. Cl.
CPC ..... *H01Q 5/385* (2015.01); *H01Q 5/392* (2015.01); *H01Q 19/005* (2013.01)

(58) Field of Classification Search
CPC ..... H01Q 19/005; H01Q 5/385; H01Q 5/392
USPC ..... 343/700 MS, 817, 818, 834, 846
See application file for complete search history.

(56) References Cited

U.S. PATENT DOCUMENTS

| | | | | |
|---|---|---|---|---|
| 6,429,818 | B1 * | 8/2002 | Johnson | H01Q 1/243 343/700 MS |
| 6,650,294 | B2 * | 11/2003 | Ying | H01Q 1/243 343/700 MS |
| 7,324,054 | B2 * | 1/2008 | Ozkar | H01Q 5/00 343/702 |
| 7,388,543 | B2 * | 6/2008 | Vance | H01Q 1/243 343/700 MS |
| 8,593,354 | B2 * | 11/2013 | Tai | H01Q 9/0421 343/700 MS |
| 9,136,601 | B2 * | 9/2015 | Yang | H01Q 9/06 |
| 2016/0134017 | A1 * | 5/2016 | Lin | H01Q 5/335 343/861 |

* cited by examiner

*Primary Examiner* — Tho G Phan
(74) *Attorney, Agent, or Firm* — Na Xu; IPro, PLLC

(57) ABSTRACT

A multi-band antenna includes a radiating antenna member, a first parasitic antenna member, and a second parasitic antenna member. The radiating antenna member includes a feeding unit, a high frequency (HF) radiating unit and a low frequency (LF) radiating unit, the HF radiating unit and the LF radiating unit extend from the feeding unit. The first parasitic antenna member includes an HF grounding part, and an HF parasitic unit extending from the HF grounding part and adjacent to the HF radiating unit. The second parasitic antenna member includes an LF grounding part, and an LF parasitic unit extending from the LF grounding part and electromagnetically coupled to the LF radiating unit. The feeding unit is arranged between the HF grounding part and the LF grounding part; the feeding unit and the HF radiating unit define a receiving slot, and the HF parasitic unit is arranged in the receiving slot.

20 Claims, 2 Drawing Sheets

MULTI-BAND ANTENNA

FIELD OF THE DISCLOSURE

The present disclosure generally relates to antenna technologies, and more particularly, to a multi-band antenna supporting multiple frequency bands, which is applicable to a wireless electronic device.

BACKGROUND

Antennas are normally used in wireless electronic devices such as mobile terminals for converting electric power into radio waves, and vice versa. The radio waves may carry digital signals or analog signals which are modulated into radio frequencies, and can be transmitted to or received from wireless channels in space by the antennas.

With the developments of wireless communication technologies, a typical mobile terminal (e.g., a smart phone or a tablet personal computer) needs to implement various wireless communication services, including long term evolution (LTE) communication services. The various wireless communication services may be modulated into different frequency bands, and thus the mobile terminal needs to include multiple antennas each of which supports a respective frequency band. However, the multiple antennas should occupy a large component space in the mobile terminal. This is adverse to miniaturization of the mobile terminal and may also increase a total cost of the mobile terminal.

Therefore, it is desired to provide a multi-band antenna which supports multiple frequency bands to overcome the aforesaid problems.

BRIEF DESCRIPTION OF THE DRAWINGS

Many aspects of the embodiment can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and the embodiment thereof.

Figure 1:
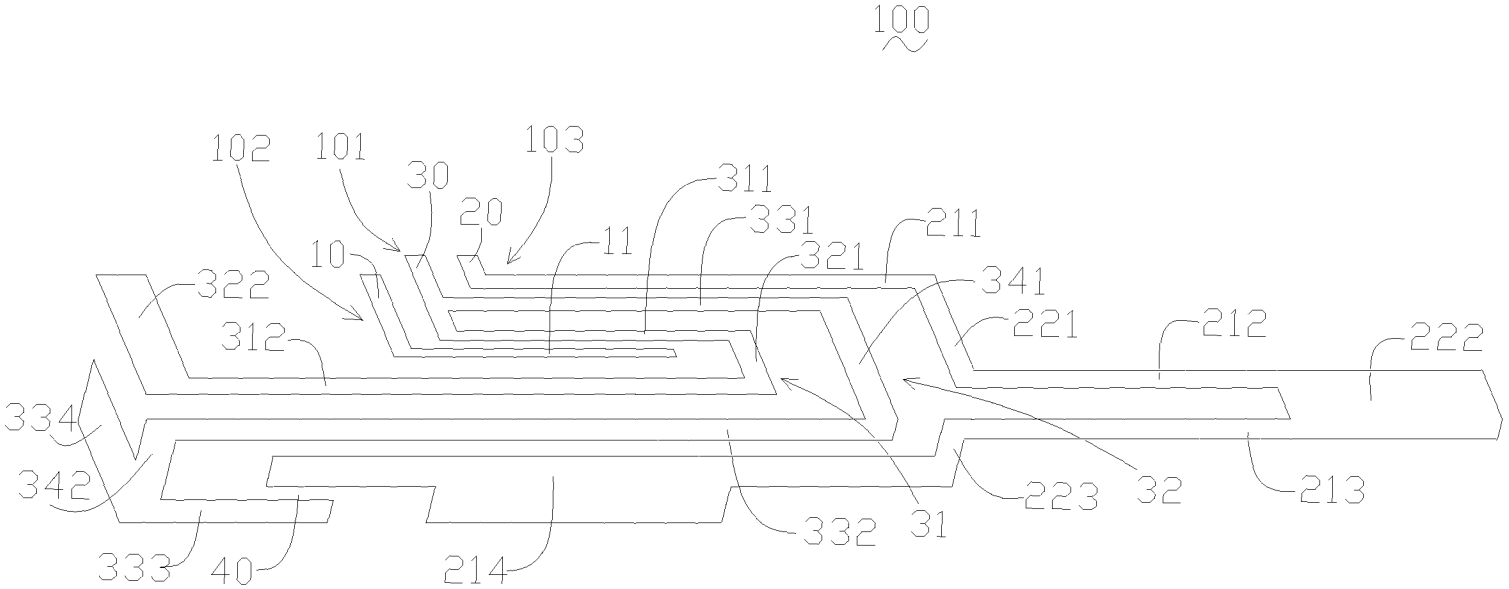
FIG. 1 is a schematic view of a multi-band antenna according to an exemplary embodiment of the present disclosure.

Referring to FIG. 1, a multi-band antenna 100 according to an exemplary embodiment of the present disclosure is shown. The multi-band antenna 100 is applicable to a wireless electronic device such as a mobile terminal. The multi-band antenna 100 includes a radiating antenna member 101, a first parasitic antenna member 102 and a second parasitic antenna member 103. The first parasitic antenna member 102 and the second parasitic antenna member 103 may be a high frequency (HF) parasitic antenna and a low frequency (LF) parasitic antenna respectively.

The first parasitic antenna member 102 includes an HF grounding part 10 and an HF parasitic unit 11. Each of the HF grounding part 10 and the HF parasitic unit 11 is in a stripe shape, and the HF parasitic unit 11 extends from an end of the HF grounding part 10 towards the radiating antenna member 101, to form an L-shaped configuration.

The radiating antenna member 101 includes a feeding unit 30, a first radiating unit 31 and a second radiating unit 32. The feeding unit 30 is also in a stripe shape, and is substantially parallel to the HF grounding part 10 of the first parasitic antenna member 102. An end of the feeding unit 30, which is adjacent to the first radiating unit 31 and the second radiating unit 32, is defined as a connecting end (not labeled). In the present disclosure, it is assumed that the stripe-shaped feeding unit 30 extends along a longitudinal direction, and in the following description, a longitudinal stripe is defined as a strip with an extending direction approximately parallel to the stripe-shaped feeding unit 30, and a latitudinal strip is defined as a strip with an extending direction approximately perpendicular to the stripe-shaped feeding unit 30.

The first radiating unit 31 and the second radiating unit 32 may be an HF radiating unit and an LF radiating unit respectively. The first radiating unit 31 extends and zigzags from the connecting end of the feeding unit 30, and is adjacent to the HF parasitic unit 11 of the first parasitic antenna member 102; the second radiating unit 32 extends and zigzags from a region of the feeding unit 30 adjacent to the connecting end of the feeding unit 30. In the present embodiment, an extending direction and a zigzagging trail of the first radiating unit 31 are substantially consistent with that of the second radiating unit 32.

The first radiating unit 31 includes a first HF radiating latitudinal stripe 311, a first HF radiating longitudinal tripe 321, a second HF radiating latitudinal stripe 312 and a second HF radiating longitudinal stripe 322, each of which is in a stripe shape. The first HF radiating latitudinal stripe 311 extends opposite to the HF grounding part 10 from the connecting end of the feeding unit 30, and is adjacent to and approximately parallel to the HF parasitic unit 11. The first HF radiating longitudinal stripe 321 extends opposite to the feeding unit 30 from an end of the first HF radiating latitudinal stripe 311, and is approximately parallel to the feeding unit 30. The second HF radiating latitudinal stripe 312 extends towards the HF parasitic unit 11 from an end of the first HF radiating longitudinal stripe 321, and is approximately parallel to the first HF radiating latitudinal stripe 311. The second HF radiating longitudinal stripe 322 extends towards the HF grounding part 10 from an end of the second HF radiating latitudinal stripe 312, and is approximately parallel to the HF grounding part 10.

With the above-described configuration, the feeding unit 30, the first HF radiating latitudinal tripe 311, the first HF radiating longitudinal tripe 321, the second HF radiating latitudinal stripe 312 and the second HF radiating longitudinal stripe 322 cooperatively form an L-shaped receiving slot, and the first parasitic antenna member 102 is located within the L-shaped receiving slot. As such, the first parasitic antenna member 102 as provided in the present disclosure is capable of expanding an available high frequency bandwidth without occupying an excessive space.

The second radiating unit 32 includes a first LF radiating latitudinal stripe 331, a first LF radiating longitudinal tripe 341, a second LF radiating latitudinal stripe 332 and a second LF radiating longitudinal stripe 342, each of which is in a stripe shape. The first LF radiating latitudinal stripe 331 extends opposite to the HF grounding part 10 from a region of the feeding unit 30 adjacent to the connecting end thereof, and is approximately parallel to the first HF radiating latitudinal stripe 311. The first LF radiating longitudinal stripe 341 extends opposite to the feeding unit 30 from an end of the first LF radiating latitudinal stripe 331, and is approximately parallel to the HF radiating longitudinal stripe 321. The second LF radiating latitudinal stripe 332 extends towards the feeding unit 30 from an end of the first LF radiating longitudinal stripe 341, and is approximately parallel to the second HF radiating latitudinal stripe 312. The second LF radiating longitudinal stripe 342 extends opposite to the first LF radiating longitudinal stripe 341 from an end of the second LF radiating latitudinal stripe 332.

Moreover, the second radiating unit 32 may further include a third LF radiating latitudinal stripe 333 and a fourth LF radiating latitudinal stripe 334. The third LF radiating latitudinal stripe 333 and the fourth radiating latitudinal stripe 334 extend respectively from a same end of the second LF radiating longitudinal stripe 342. In particular, the third LF radiating latitudinal stripe 333 extends towards the first LF radiating longitudinal stripe 341, and is approximately parallel to the second LF radiating latitudinal stripe 332 but shorter than the second LF radiating latitudinal stripe 332. The fourth LF radiating latitudinal stripe 334 may extend opposite to the LF radiating latitudinal stripe 332.

The second parasitic antenna member 103 includes an LF grounding part 20 that is parallel to the feeding unit 30 of the radiating antenna member 101 and the HF grounding part 10 of the first parasitic antenna member 102. The LF grounding part 20 and the HF grounding part 10 are respectively arranged at two opposite sides of the feeding unit 30.

Moreover, the second parasitic antenna member 103 may further include a first LF parasitic latitudinal stripe 211, a first LF parasitic longitudinal stripe 221, a second LF parasitic latitudinal stripe 212, a second LF parasitic longitudinal stripe 222, a third LF parasitic latitudinal stripe 213, a third LF parasitic longitudinal stripe 223, and a fourth LF parasitic latitudinal stripe 214, each of which is also in a stripe shape. The first LF parasitic latitudinal stripe 211, the first LF parasitic longitudinal stripe 221, the second LF parasitic latitudinal stripe 212, the second LF parasitic longitudinal stripe 222, the third LF parasitic latitudinal stripe 213, the third LF parasitic longitudinal stripe 223 and the fourth LF parasitic latitudinal stripe 214 are connected in sequence to constitute an LF parasitic unit which is adjacent to the second radiating unit 32 of the radiating antenna member 101.

The first LF parasitic latitudinal stripe 211 extends opposite to the feeding unit 30 from an end of the LF grounding part 20, and is adjacent to and approximately parallel to the LF radiating latitudinal stripe 331. The first LF parasitic longitudinal stripe 221 extends opposite to the LF grounding part 20 from an end of the first LF parasitic latitudinal stripe 211, and is approximately parallel to the first LF radiating longitudinal stripe 341.

The second LF parasitic latitudinal stripe 212 extends opposite to the first LF parasitic latitudinal stripe 211 from an end of the first LF parasitic longitudinal stripe 221, and is approximately parallel to the first LF parasitic latitudinal stripe 211. The second LF parasitic longitudinal stripe 222 extends opposite to the first LF parasitic longitudinal stripe 221 from an end of the second LF parasitic latitudinal stripe 212, and may have a width substantially greater than other stripes of the second parasitic antenna member 103. The third LF parasitic latitudinal stripe 213 extends towards the LF grounding part 20 from an end of the second LF parasitic longitudinal stripe 222, and is approximately parallel to the second LF parasitic latitudinal stripe 212. Accordingly, the second LF parasitic latitudinal stripe 212, the second LF parasitic longitudinal stripe 222 and the third LF parasitic latitudinal stripe 213 may cooperatively form a U-shaped configuration.

The third LF parasitic longitudinal stripe 223 extends opposite to the LF parasitic longitudinal stripe 222 from an end of the third LF parasitic latitudinal stripe 213, and is approximately parallel to the second LF radiating longitudinal stripe 342. The fourth LF parasitic latitudinal stripe 214 extends opposite to the third LF parasitic latitudinal stripe 213 from an end of the third LF parasitic longitudinal stripe 223, and is adjacent to and approximately parallel to and adjacent to the second LF radiating latitudinal stripe 332.

Furthermore, an end of the fourth LF parasitic latitudinal stripe 214 extends to a region between the third LF radiating latitudinal stripe 333 and the second LF radiating latitudinal stripe 332, so that a coupling gap 40 is formed between the fourth LF parasitic latitudinal stripe 214 and the third LF radiating latitudinal stripe 333. The fourth LF parasitic latitudinal stripe 214 may be electromagnetically coupled to the third LF radiating latitudinal stripe 333 via the coupling gap 40, and consequently a low frequency performance of the multi-band antenna 100 as provided in the present disclosure can be improved.

In the present embodiment, the multi-band antenna 100 may be arranged on three planes, namely a first plane, a second plane and a third plane, in which any two planes are perpendicular to each other. Specifically, the first parasitic antenna member 102, the feeding unit 30, the first radiating unit 31, a part of the second radiating unit 32 (e.g., the first LF radiating latitudinal stripe 331 and the first LF radiating longitudinal stripe 341) and a part of the second parasitic antenna member 103 (e.g., the LF grounding part 20, the first LF parasitic latitudinal stripe 211, the first LF parasitic longitudinal stripe 221, the second LF parasitic latitudinal stripe 212 and the second LF parasitic longitudinal stripe 222) are arranged on the first plane; another part of the second radiating unit 32 (e.g., the second LF radiating latitudinal stripe 332, the second LF radiating longitudinal stripe 342 and the third LF radiating latitudinal stripe 333) and the rest part of the second parasitic antenna member 103 (e.g., the third LF parasitic latitudinal stripe 213, the third LF parasitic longitudinal stripe 223 and the fourth LF parasitic latitudinal stripe 214) are arranged on the second plane; and the rest part of the second radiating unit 32 (e.g., the fourth LF radiating latitudinal stripe 334) is arranged on the third plane. With this arrangement, a coverage area of the multi-band antenna 100 can be enlarged, and thus a total available frequency bandwidth of the multi-band antenna 100 can be broadened.

Figure 2:
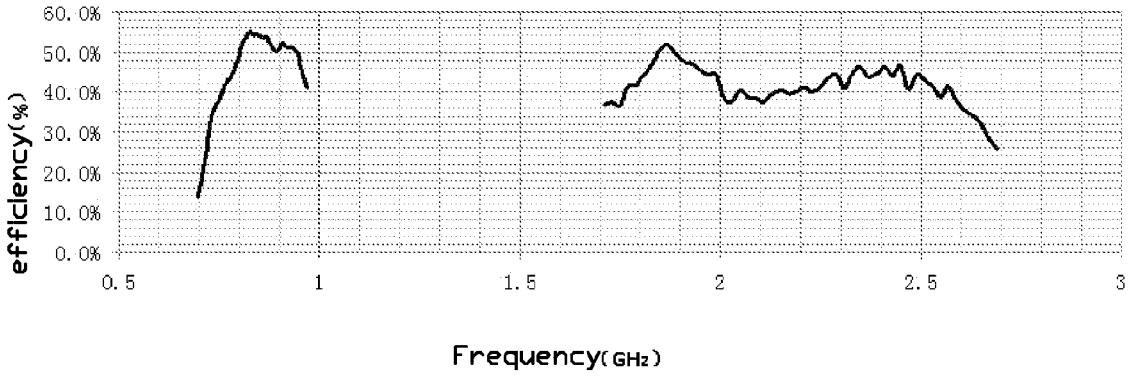
FIG. 2 illustrates an operation efficiency diagram obtained by performing a testing under a condition that a low frequency grounding part of the multi-band antenna in FIG. 1 is grounded.
Figure 3:
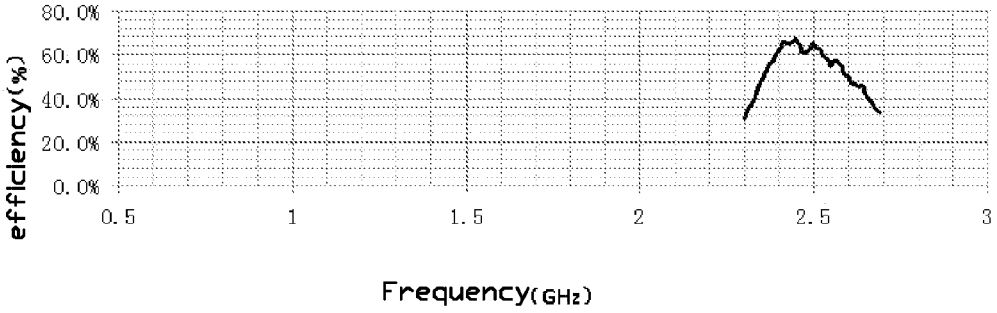
FIG. 3 illustrates an operation efficiency diagram obtained a testing under a condition that the low frequency grounding part of the multi-band antenna in FIG. 1 is not grounded.

Furthermore, the multi-band antenna 100 as provided in the present disclosure may further include a radio frequency (RF) switch; the RF switch is configured for controlling whether or not the LF grounding part 20 is grounded. When the RF switch controls the LF grounding part 20 to be grounded, the second parasitic antenna member 103 is electromagnetically coupled to the second radiating unit 32 of the radiating antenna member 101, and thus a low frequency performance of the multi-band antenna 100 can be improved, as illustrated in FIG. 2. When the RF switch controls the LF grounding part 20 to be non-grounded, the second parasitic antenna member 103 is disabled and stops working, and thus a high frequency performance of the multi-band antenna 100 is improved, as illustrated in FIG. 3. From the illustration of FIG. 2 and FIG. 3, it can be found that high frequency operation efficiency of the multi-band antenna 100 when the LF grounding part 20 is not grounded is much greater than that when the LF grounding part 20 is grounded.

In the multi-band antenna 100 as provided in the present disclosure, due to the electromagnetic coupling between the second parasitic antenna member 103 and the second radiating unit 32, double resonance can be obtained in the low frequency band; therefore, the multi-band antenna 100 is capable of covering a low frequency band range from 698 MHz to 960 MHz, in which the second generation (2G) or the third generation (3G) communication services as well as the LTE communication services are modulated. Besides, the multi-band antenna 100 can also attain quadruple resonance in the high frequency band, which covers a high frequency band range from 1710 MHz to 2690 MHz.

In summary, in the present disclosure, parasitic coupling effect is employed in the multi-band antenna 100 to realize the multiple frequency bands, which can not only occupy less space and facilitate miniaturization of the multi-band antenna 100, but also enlarge the low frequency bandwidth and high frequency bandwidth thereof, and moreover, the operation efficiency of the multi-band antenna 100 in both the low frequency band and the high frequency band can also be improved. Furthermore, since the multi-band antenna 100 supports multiple frequency bands in a single antenna, it is unnecessary to arrange multiple antennas within a wireless electronic device, this can lower a total cost of the wireless electronic device.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-band antenna, comprising:

a radiating antenna member, comprising a feeding unit, a high frequency (HF) radiating unit and a low frequency (LF) radiating unit, the HF radiating unit and the LF radiating unit extending from the feeding unit;

a first parasitic antenna member, comprising an HF grounding part and an HF parasitic unit, the HF parasitic unit extending from the HF grounding part and being adjacent to the HF radiating unit; and a second parasitic antenna member, comprising an LF grounding part and an LF parasitic unit extending from the LF grounding part, the LF parasitic unit being electromagnetically coupled to the LF radiating unit;

wherein the feeding unit is arranged between the HF grounding part and the LF grounding part, the feeding unit and the HF radiating unit cooperatively define a receiving slot, and the HF parasitic unit is arranged in the receiving slot.

2. The multi-band antenna of claim 1, wherein the feeding unit is in a stripe shape and extends along a longitudinal direction.

3. The multi-band antenna of claim 2, wherein the HF radiating unit zigzags from a connecting end of the feeding unit, and the LF radiating unit zigzags from a region of the feeding unit adjacent to the connecting end of the feeding unit; a zigzagging trail of the first radiating unit is substantially consistent with that of the second radiating unit.

4. The multi-band antenna of claim 3, wherein the HF radiating unit comprises a first HF radiating latitudinal stripe, a first HF radiating longitudinal stripe, a second HF radiating latitudinal strip and a second HF radiating longitudinal stripe; the feeding unit, the first HF radiating latitudinal stripe, the second HF radiating latitudinal strip and the second HF radiating longitudinal stripe are connected in sequence for forming an L-shaped receiving slot, and the first parasitic antenna member is arranged in the L-shaped receiving slot.

5. The multi-band antenna of claim 2, wherein the HF parasitic unit extends from an end of the feeding unit so that the first parasitic antenna member has an L-shaped configuration.

6. The multi-band antenna of claim 4, wherein the first HF radiating latitudinal stripe extends opposite to the HF grounding part from an end of the feeding unit, the first HF radiating longitudinal stripe extends opposite to the feeding unit from an end of the first HF radiating latitudinal stripe, the second HF radiating latitudinal stripe extends towards the HF parasitic unit from an end of the first HF radiating longitudinal stripe, and the second HF radiating longitudinal stripe extends towards the HF grounding part from an end of the second HF radiating latitudinal strip.

7. The multi-band antenna of claim 6, wherein both the first HF radiating latitudinal stripe and the second HF radiating latitudinal stripe are approximately parallel to the HF parasitic unit; the feeding unit, the first HF radiating longitudinal stripe and the second HF radiating longitudinal stripe are approximately parallel to the HF grounding part.

8. The multi-band antenna of claim 6, wherein the LF radiating unit comprises a first LF radiating latitudinal stripe extending opposite to the HF grounding part from a region of the feeding unit adjacent to the connecting end thereof, a first LF radiating longitudinal stripe extending opposite to the feeding unit from an end of the first LF radiating latitudinal stripe, a second LF radiating latitudinal strip extending towards the feeding unit from an end of the first LF radiating longitudinal stripe, and a second LF radiating longitudinal stripe extending opposite to the first LF radiating longitudinal stripe from an end of the second LF radiating latitudinal stripe.

9. The multi-band antenna of claim 8, wherein the first LF radiating latitudinal stripe, the first LF radiating longitudinal stripe and the second LF radiating latitudinal strip are approximately parallel to the first HF radiating latitudinal stripe, the first HF radiating longitudinal stripe and the second HF radiating latitudinal strip, respectively.

10. The multi-band antenna of claim 8, wherein the LF radiating unit further comprises a third LF radiating latitudinal stripe and a fourth LF radiating latitudinal stripe extending respectively from a same end of the second LF radiating longitudinal stripe; the third LF radiating latitudinal stripe is coplanar with the second LF radiating longitudinal stripe and is approximately parallel to the second HF radiating latitudinal strip, the fourth LF radiating latitudinal stripe is arranged in a different plane from the second LF radiating longitudinal stripe.

11. The multi-band antenna of claim 10, wherein the LF parasitic unit comprises a first LF parasitic latitudinal stripe extending opposite to the feeding unit from an end of the LF grounding part, a first LF parasitic longitudinal stripe extending opposite to the LF grounding part from an end of the first LF parasitic latitudinal stripe, a second LF parasitic latitudinal stripe extending opposite to the first LF parasitic latitudinal stripe from an end of the first LF parasitic longitudinal stripe, and a second LF parasitic longitudinal stripe extending opposite to the first LF parasitic longitudinal stripe from an end of the second LF parasitic latitudinal stripe.

12. The multi-band antenna of claim 11, wherein the LF grounding part, the first LF parasitic longitudinal stripe and the second LF parasitic longitudinal stripe are approximately parallel to the first feeding unit; and both the first LF parasitic latitudinal stripe and the second LF parasitic latitudinal stripe are approximately parallel to the LF radiating latitudinal stripe.

13. The multi-band antenna of claim 11, wherein the LF parasitic unit further comprises a third LF parasitic latitudinal stripe extending towards the LF grounding part from an end of the second LF parasitic longitudinal stripe, a third LF parasitic longitudinal stripe extending opposite to the second LF parasitic longitudinal stripe from an end of the third LF parasitic latitudinal stripe, and a fourth LF parasitic latitudinal stripe extending opposite to the third LF parasitic latitudinal stripe from an end of the third LF parasitic longitudinal stripe.

14. The multi-band antenna of claim 13, wherein the second LF parasitic longitudinal stripe has a width substantially greater than other stripes of the second parasitic antenna member.

15. The multi-band antenna of claim 14, wherein the first parasitic antenna member, the feeding unit, the first radiating unit, the first LF radiating latitudinal stripe, the first LF radiating longitudinal stripe, the LF grounding part, the first LF parasitic latitudinal stripe, the first LF parasitic longitudinal stripe, the second LF parasitic latitudinal stripe and the second LF parasitic longitudinal stripe are arranged on the first plane; the second LF radiating latitudinal stripe, the second LF radiating longitudinal stripe, the third LF radiating latitudinal stripe, the third LF parasitic latitudinal stripe, the third LF parasitic longitudinal stripe and the fourth LF parasitic latitudinal stripe are arranged on the second plane; and the fourth LF radiating latitudinal stripe 334 is arranged on the third plane.

16. The multi-band antenna of claim 13, wherein the third LF parasitic latitudinal stripe and the fourth LF parasitic latitudinal stripe are approximately parallel to the second LF parasitic latitudinal stripe; and the third LF parasitic longitudinal stripe is approximately parallel to the second LF radiating longitudinal stripe.

17. The multi-band antenna of claim 13, wherein an end of the fourth LF parasitic latitudinal stripe extends to a region between the third LF radiating latitudinal stripe and the second LF radiating latitudinal stripe, and a coupling gap is formed between the fourth LF parasitic latitudinal stripe and the third LF radiating latitudinal stripe.

18. The multi-band antenna of claim 17, wherein the fourth LF parasitic latitudinal stripe is electromagnetically coupled to the third LF radiating latitudinal stripe via the coupling gap.

19. The multi-band antenna of claim 13, wherein the multi-band antenna is arranged on a first plane, a second plane and a third plane, any two planes are perpendicular to each other.

20. The multi-band antenna of claim 1, wherein when the multi-band antenna works in a low frequency band, the LF grounding part is grounded under control of a radio frequency (RF) switch, and thereby enabling the second parasitic antenna member to be electromagnetically coupled to the LF radiating unit of the radiating antenna member; and when the multi-band antenna works in a high frequency band, the LF grounding band is not grounded under control of the RF switch to disable the second parasitic antenna member.

* * * * *